US008643275B2

(12) United States Patent
Tabib-Azar

(10) Patent No.: US 8,643,275 B2
(45) Date of Patent: Feb. 4, 2014

(54) MICRO-PLASMA FIELD EFFECT TRANSISTORS

(75) Inventor: Massood Tabib-Azar, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 13/586,717

(22) Filed: Aug. 15, 2012

(65) Prior Publication Data

US 2013/0113370 A1 May 9, 2013

Related U.S. Application Data

(60) Provisional application No. 61/628,876, filed on Nov. 8, 2011.

(51) Int. Cl.
*H01J 17/04* (2012.01)

(52) U.S. Cl.
USPC ..... 313/581

(58) Field of Classification Search
CPC ... H01J 37/321; H01J 37/32449; G03B 21/56
USPC ..... 315/111.21, 111.51, 111.71; 313/567, 313/641, 581–587, 153–162; 438/719
See application file for complete search history.

(56) References Cited

U.S. PATENT DOCUMENTS

| | | | | |
|---|---|---|---|---|
| 5,387,777 | A * | 2/1995 | Bennett et al. | 219/121.43 |
| 2010/0236917 | A1 * | 9/2010 | Mori | 204/164 |
| 2011/0024048 | A1 * | 2/2011 | Nakamura et al. | 156/345.51 |
| 2012/0115314 | A1 * | 5/2012 | Sakamoto et al. | 438/479 |

* cited by examiner

*Primary Examiner* — Tracie Y Green
(74) *Attorney, Agent, or Firm* — Michael Best & Friedrich LLP

(57) ABSTRACT

In some aspects, a micro-plasma device comprises a plasma gas enclosure containing at least one plasma gas, a plasma generation circuit interfaced with the plasma gas enclosure, and a plurality of electrodes interfaced with the plasma gas enclosure. In other aspects, a micro-plasma circuitry apparatus comprises a first layer having plasma generating electrodes, a second layer having a cavity formed therein, and a third layer having a circuit formed therein. The circuit includes a micro-plasma circuit (MPC) that includes one or more micro-plasma devices (MPDs). A metallic layer covers the MPC except at locations of the MPDs. The first layer is bonded to the second layer and the second layer is bonded to the third layer, thereby forming an enclosure that contains at least one plasma gas.

24 Claims, 13 Drawing Sheets

MICRO-PLASMA FIELD EFFECT TRANSISTORS

CROSS-REFERENCE TO RELATED APPLICATIONS

This application claims priority to U.S. Provisional Patent Application No. 61/628,876, filed Nov. 8, 2011 and entitled, "CAPACITIVELY COUPLED ATMOSPHERIC RF MICROPLASMA DEVICES," the disclosure of which is incorporated herein by reference.

TECHNICAL FIELD

The present description relates generally to field effect transistors, and relates in particular to micro-plasma field effect transistors.

BACKGROUND

Complementary metal-oxide-semiconductor (CMOS) devices, metal-oxide-semiconductor field-effect transistor (MOSFET) devices, and other semiconductor switching devices generally do not tolerate harsh environments, such as heat and radiation. For example, a typical CMOS or MOSFET will usually fail at temperatures exceeding 200° C. As a result, computers or processors may fail in an emergency fire condition, and cannot be placed inside high-temperature devices such as internal combustion engines. Additionally, CMOS or MOSFET devices will fail in high radiation environments. As a result, computers or processors can become disabled in the presence of ionizing radiation produced by reactors during, for example, an emergency requiring intervention using robots or other computerized devices.

The vulnerability of semiconductor switching devices to extreme heat and radiation stems from the nature of semiconductor materials. Semiconductor materials are responsive to stimulation in order to become more conductive, and electrical signals are used to selectively stimulate the materials in order to cause conduction. However, heat and ionizing radiation can also stimulate semiconductor materials. As a result, the semiconductor materials simply short out when excited by heat or ionizing radiation. Accordingly, there is a need for switching devices that can tolerate such harsh environments.

BRIEF SUMMARY

The present application provides for systems devices and methods which provide for micro plasma field effect transistors. Further, embodiments may provide for such transistors that have a capability to withstand high-temperature or radioactive environments.

In some aspects, a micro-plasma device comprises a plasma gas enclosure containing at least one plasma gas, a plasma generation circuit interfaced with the plasma gas enclosure, and a plurality of electrodes interfaced with the plasma gas enclosure. In other aspects, a micro-plasma circuitry apparatus comprises a first layer having plasma generating electrodes, a second layer having a cavity formed therein, and a third layer having a circuit formed therein. The circuit includes a micro-plasma circuit (MPC) that includes one or more micro-plasma devices (MPDs). A metallic layer covers the MPC except at locations of the MPDs. The first layer is bonded to the second layer and the second layer is bonded to the third layer, thereby forming an enclosure that contains at least one plasma gas.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 2(*b*) depicts an isometric view of a MOPFET in accordance with the present disclosure;

FIG. 3(*b*) depicts another graphical representation of MOPFET Ids-Vds characteristics in accordance with the present disclosure;

FIG. 4(*b*) a sectional view of the IDT fields in accordance with the present disclosure;

FIG. 4(*c*) and a graphical representation of the position dependence of plasma conductance in accordance with the present disclosure;

FIG. 5(*b*) depicts a graphical representation of plasma conductance as a function of excitation frequency in accordance with the present disclosure;

FIG. 5(*c*) depicts a graphical representation of plasma conductance as a function of excitation amplitude in accordance with the present disclosure;

FIG. 6(*b*) depicts a diagrammatic view of a NOR gate in accordance with the present disclosure;

FIG. 6(*c*) depicts a diagrammatic view of a NAND gate in accordance with the present disclosure;

FIG. 7(*b*) depicts a sectional view of an anodic bonding arrangement in accordance with the present disclosure;

DETAILED DESCRIPTION

The present disclosure is directed to microplasma devices (MPD) capable of operating in ionizing radiations and at high temperatures (e.g. temperatures ranging between 200-600° C.). In one embodiment, a radio frequency (RF) plasma source provides plasma for the circuit operation to eliminate the uncertainty associated with ignition. Micro-plasma circuits (MPC) capable of performing simple logical functions such as NOT, NOR and NAND may be provided. Plasma devices for amplification and mixing may also be provided. Metal and ceramic resistors and capacitors may be used along with metallic inductors in the MPCs. Quartz resonators, tested to operate in radiation environment without deterioration, may be used for clocks. MPC devices may be connected using shielded metal lines to prevent distributed parasitic interactions with the plasma.

Figure 1:
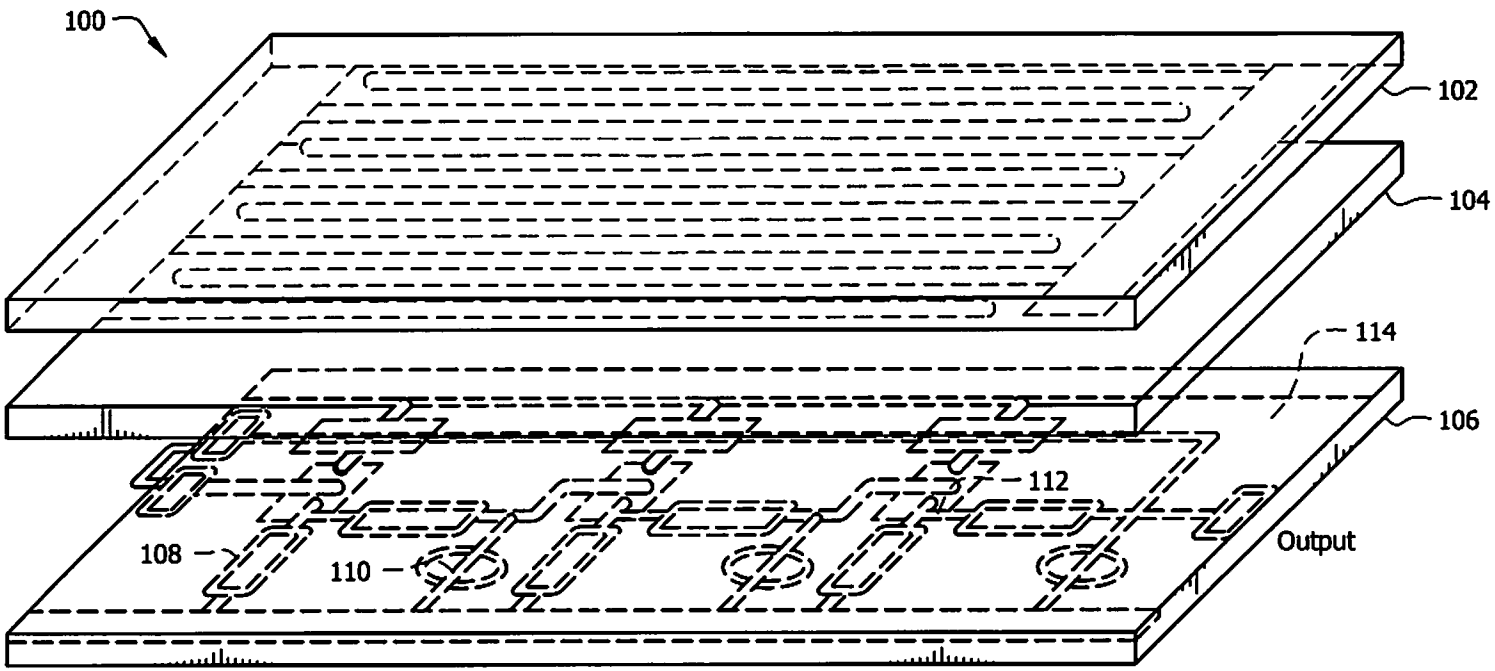
FIG. 1 depicts a schematic of a micro-plasma circuit chip in accordance with the present disclosure.

Referring to FIG. 1, a micro-plasma circuit, according to one embodiment, may be comprised of fused silica or similar materials, which do not deteriorate in ionizing radiation. The micro-plasma circuit chip 100 may be composed of three main fused silica sections. A top fused silica plate 102 may contain RF plasma generation electrodes forming an RF plasma generation circuit, and it may be bonded to a middle fused silica section 104 that encloses the plasma gases and the plasma. Example plasma gases can be noble gases, such as Helium (He), Xenon (Xe), Neon (Ne), Argon (Ar) and the like. A bottom fused silica plate 106 may contain the circuit, such as a ring oscillator. The circuit may include standard elements, such as resistors 108 and capacitors 110. However, the circuit also includes the MPD 112 and MPCs. The MPC may be shielded from the plasma with a metallic layer 114 that covers the MPC everywhere except in the MPD regions.

Figure 2A:
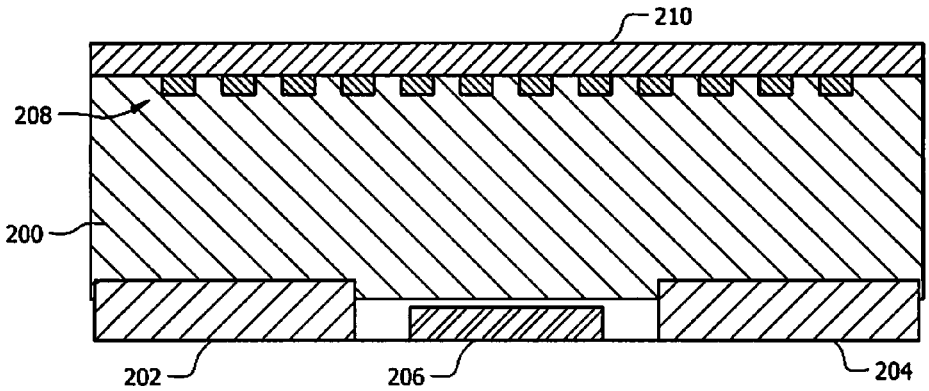
FIG. 2(*a*) depicts a sectional view of a metal-oxide-plasma field-effect transistor (MOPFET) device in accordance with the present disclosure.
Figure 2B:
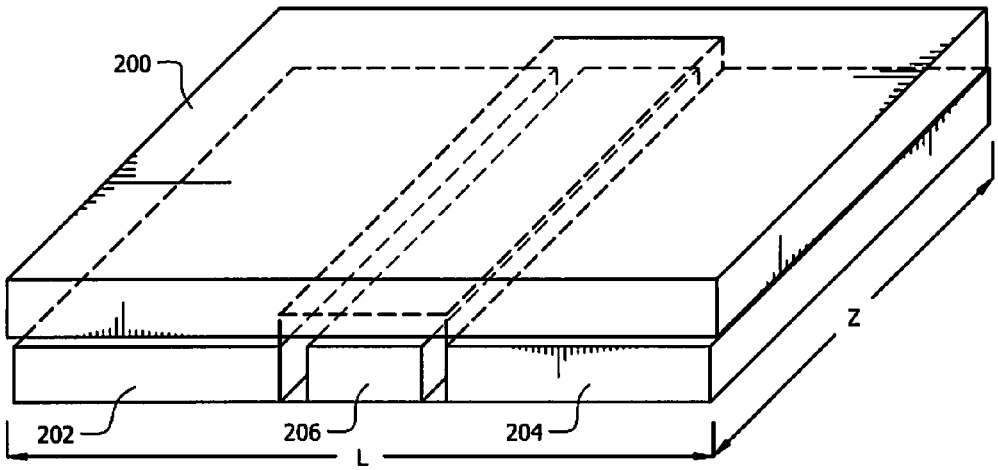

According to some embodiments, the MPDs may comprise metal-oxide-plasma field-effect transistors (MOPFET) that may serve as switching and amplifying devices for the MPCs. Compared to field-emission and micro-vacuum devices, separate generation of plasma enables MOPFETs to operate at lower voltage levels and higher currents, and with much higher reproducibility and reliability. FIG. 2 provides a schematic of such a MOPFET.

Referring generally to FIG. 2, a MOPFET may have a plasma region 200 in contact with two exposed metallic electrodes, including a drain electrode 202 and a source electrode 204, separated by an insulated gate 206. Depending on the density of the plasma and the nature of the boundary layer, the MOPFET may be designed to operate as an enhancement-mode (E-MOPFET) device, or as a depletion-mode (D-MOPFET) device. Although it is possible to have negative carriers, positive ions are presently preferred because they prove to be more stable in the plasma. Referring particularly to FIG. 2(*a*), the plasma ions that are generated using the RF plasma electrodes 208 of the top plate 210 remain ionized and can be detected for relatively long distances up to a few millimeters. The positive ion mobilities (μ) are around 1-0.01 $cm^2/V_{DS}$ in 1 atmosphere pressure at room temperature. Referring to FIG. 2(*b*), for gate length L, in the constant ion mobility regime, the MOPFET switching speed can be estimated as $\tau_s \sim L^2/(\mu V_{DS})$. For $\tau_s$=100 ps, the gate length L of 5 μm requires $V_{DS}$ of 25V, assuming μ~1 $cm^2/V_{DS}$, wherein μ may be calculated according to:

$$\mu = 0.4047\left(\frac{\pi}{2}\right)^{1/2}\frac{e\tau_0}{m}\left(1 - 0.1075\frac{v_d^2}{v_s^2}\right)$$

Figure 3A:
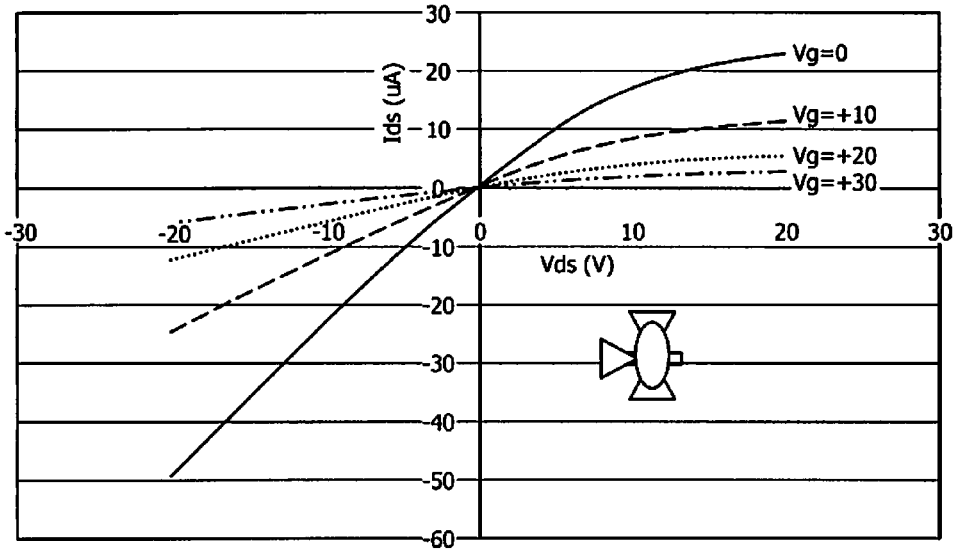
FIG. 3(*a*) depicts a graphical representation of MOPFET Ids-Vds characteristics in accordance with the present disclosure.
Figure 3B:
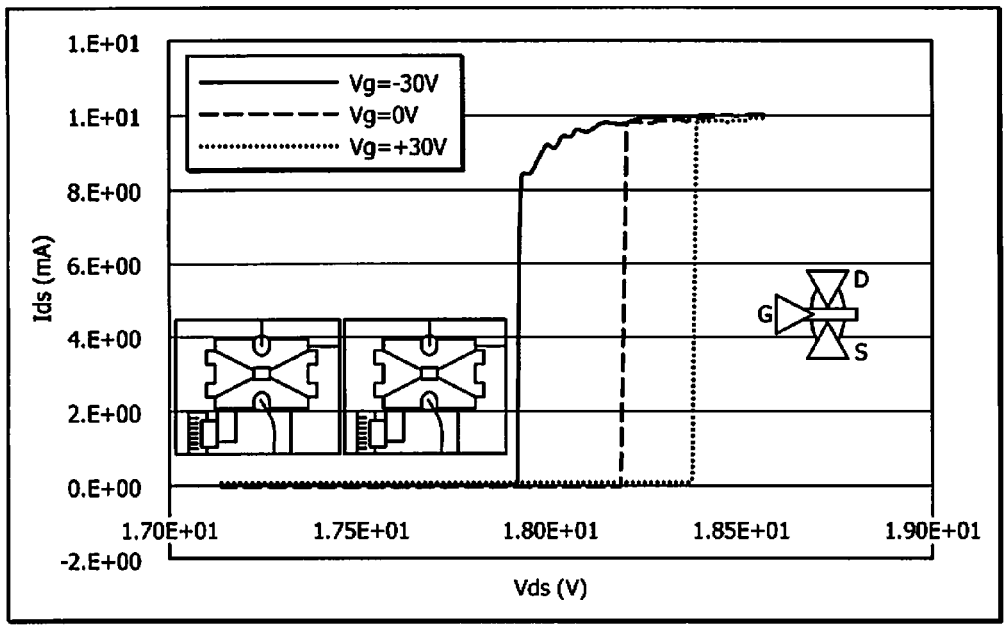

FIG. 3 illustrates Ids-Vds characteristics during two different operation regimes of MOPFETs as experimentally measured utilizing He at 1 atmosphere at room temperature. Referring to FIG. 3(*a*), in which $I_{ds}$ is measured in μA, if the plasma ion density is sufficiently high near the D-S regions, the gate field effect depletes the D-S channel to reduce the channel conductance, and the MOPFET operates as a depletion mode device. The role of the gate electrode, in this case, is to deplete the positive ions in the channel to reduce the $I_{DS}$ at any $V_{DS}$. Referring to FIG. 3(*b*), in which $I_{ds}$ is measured in mA as limited by the Keithley SMU 267 current compliance to 10 mA, the same MOPFET operates as an enhancement mode device. The enhancement mode device operation is achieved when the plasma density is low, but sufficient to enable $V_{DS}$ to ionize near-by gas molecules and increase the D-S channel conductance. The ionization voltage depends on plasma density, gate voltage, gate capacitance and device geometry. The plasma device intensity reduces when $+V_g$ is applied. Accordingly, when the plasma density is low but sufficient to enable ionization between drain and source at low voltages, the MOPFET characteristics change, allowing the MOPFET to be used as a switch having a turn-on voltage controlled by the gate voltage. The MOPFET characteristics discussed above demonstrate that the MOPFET may be used as a switch very similar to PMOS. Accordingly, logic gates using MOPFETs may be designed, and device equations may be developed to relate $I_{ds}$–$V_{ds}$ and $V_{gs}$ to device parameters, such as gate oxide, plasma density, pressure, temperature, and geometry.

A family of efficient RF plasma sources may provide the necessary ion densities for MPCs. The Interdigital Transducer (IDT) RF electrode geometry shown in FIG. 1 is ideal for generating high density plasmas in pressures ranging from $10^{-3}$ Torr up to atmospheric pressure. This pressure range can be maintained inside the bonded package. Referring to FIG.

Figure 4A:
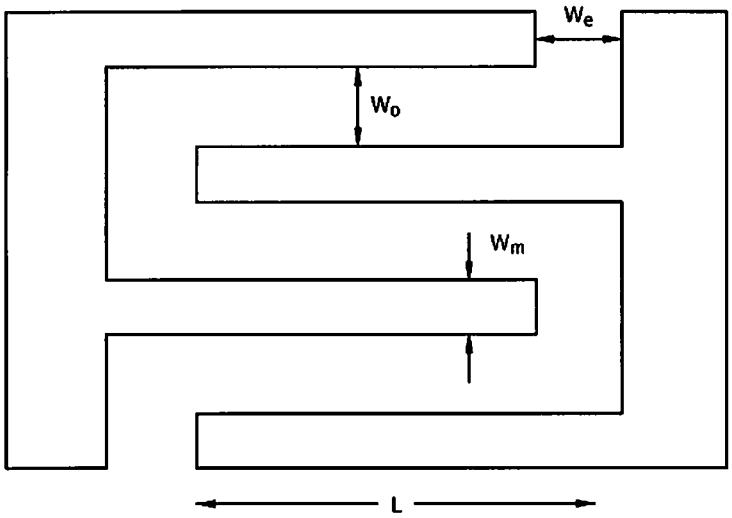
FIG. 4(*a*) depicts a plan view of interdigital transducers (IDTs) for RF plasma generation in accordance with the present disclosure.
Figure 4B:
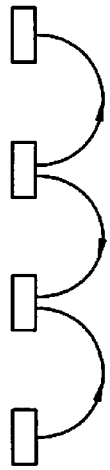
Figure 4C:
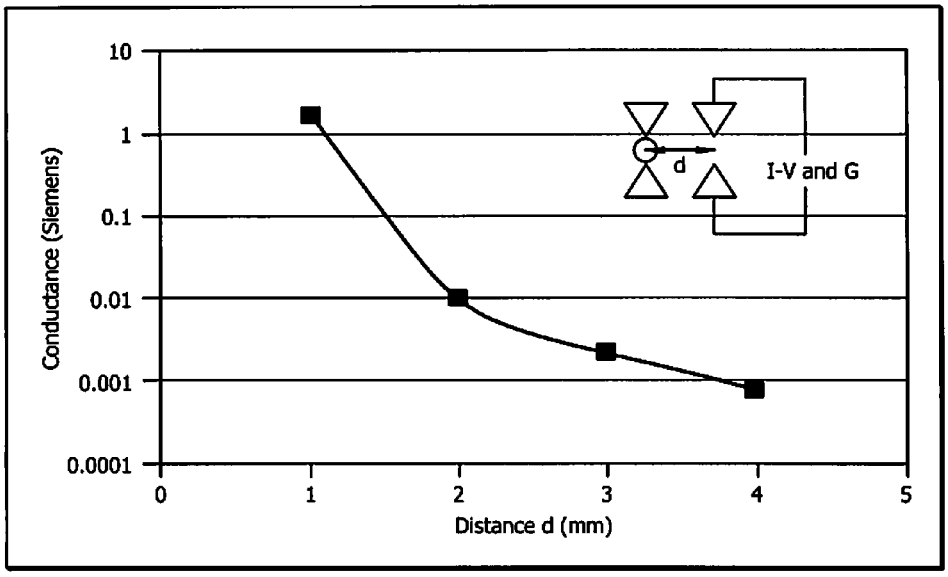

4(*a*), the IDTs can be designed to have different overlap ($L-W_e$), distance ($W_o$), electrode areas, and number of pairs. The distance can be graded to produce different field intensities at different locations. Referring to FIG. 4(*b*), an IDT field pattern can be used to adjust the plasma density. Referring to FIG. 4(*c*), plasma intensity is observed to vary as a function of distance. The plasma density has a spatial decay length of around 1 mm for He at 1 atmosphere at 480 MHz with $W_o \sim W_m \sim W_e \sim 1$ mm with one pair of IDT. A magnetic field may be employed to increase collision rate and thereby increase plasma density. Other parameters that can be taken into consideration in the design are RF power, frequency, IDT parameters, surface nano-texturing (hollow cathode effect), and gases. An equation may express the plasma decay length as a function of IDT parameters, pressure, gases (e.g., electronegative gases such as $O_2$ have completely different decay properties than He), frequency, RF power, and temperature.

Figure 5A:
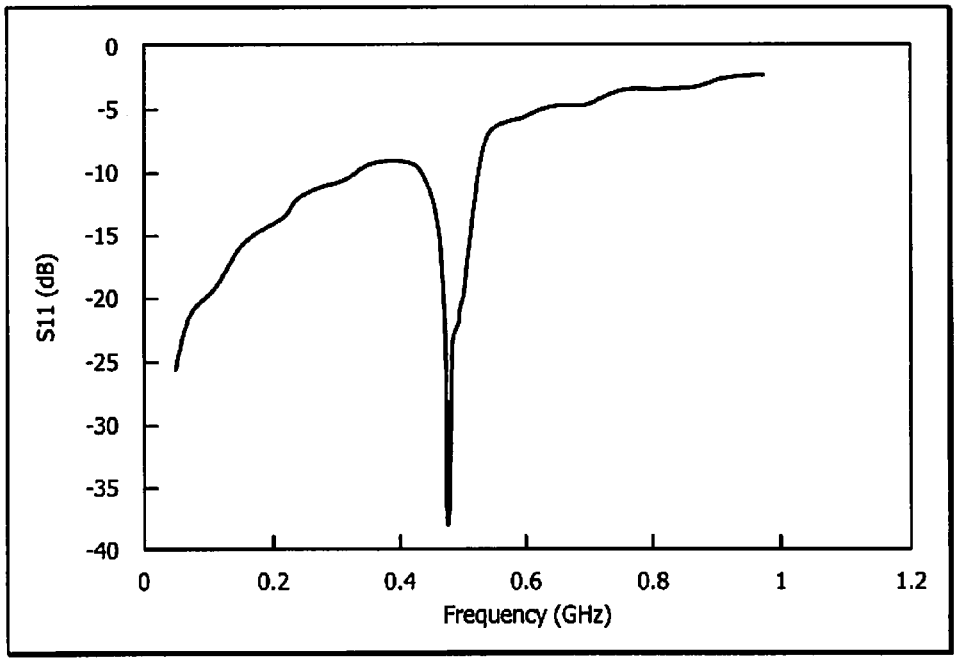
FIG. 5(*a*) depicts a graphical representation of the reflection coefficient of a single pair IDT after impedance matching in accordance with the present disclosure.
Figure 5B:
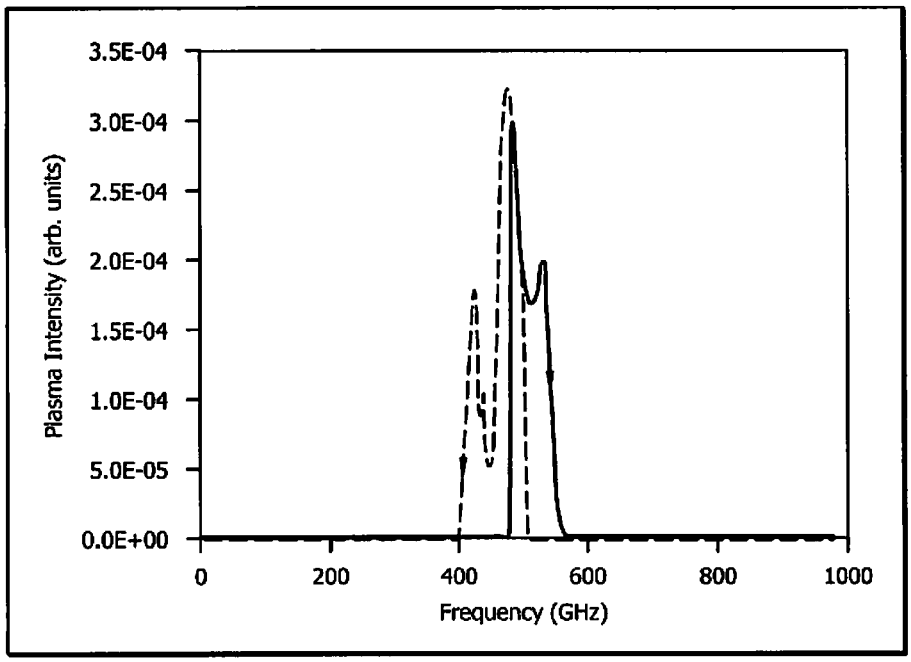
Figure 5C:
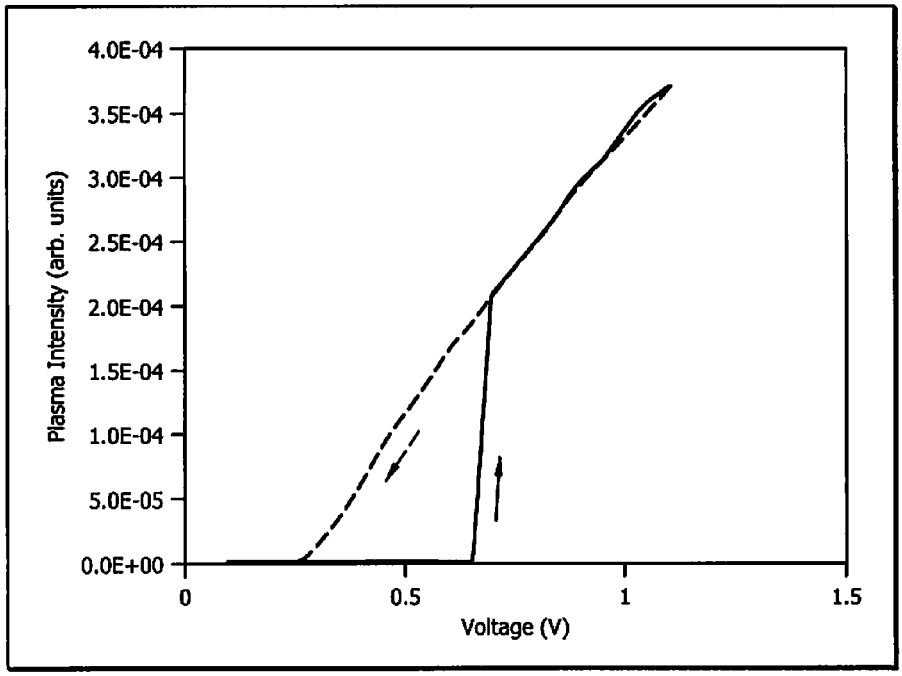

Turning now to FIG. 5(*a*), $S_{11}$ of a single pair IDT is shown after impedance matching. The IDTs are primarily capacitive, and impedance matching requires an inductor. Referring to FIG. 5(*b*), the plasma conductance as a function of excitation frequency at constant amplitude exhibits hysteresis that is usually observed in highly nonlinear processes such as gas ionization. Referring to FIG. 5(*c*), hysteresis is also observed in plasma conductance as a function of excitation amplitude at constant frequency.

Figure 6A:
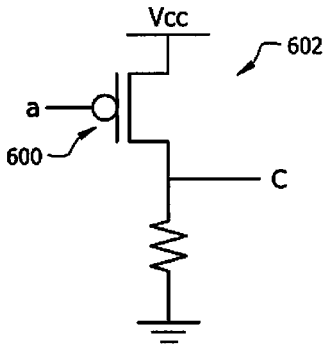
FIG. 6(*a*) depicts a diagrammatic view of an inverter in accordance with the present disclosure.
Figure 6B:
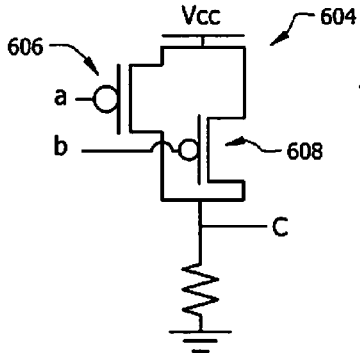
Figure 6C:
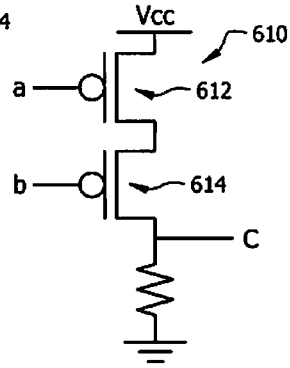

Referring now to FIG. 6, logic gates may be developed using MOPFETs. For example, FIG. 6(*a*) provides an example of an inverter employing a single MOPFET 600 to form a NOT gate 602. Additionally, FIG. 6(*b*) provides an example of a NAND gate 604 employing a first MOPFET 606 and a second MOPFET 608. Also, FIG. 6(*c*) provides an example of a NOR gate 610 employing a first MOPFET 612 and a second MOPFET 614. It will be appreciated that NOR and NAND gates are universal, and any other gates can be constructed using NOR or NAND gates. It is envisioned that D-latches and flop-flops can be constructed as well. In digital logic, the most important MOPFET parameters are speed and transition (on to off) voltages. Accordingly, it is envisioned that Non-Volatile Memory devices may be developed.

Fused silica substrates and refractory metals with low sputtering yields may be utilized as materials to increase the MPCs operation lifetime in radiation and high temperatures. Preliminary studies clearly show that, for high performance MPDs, inorganic high temperature substrates (i.e., fused silica) are superior to other substrates. Different sections of the MP chips may be bonded (anodic and eutectic) to provide sealed cavities for plasma gases.

It is possible to physically grow nano-wires between the drain and source contacts and proper gate biasing and an appropriate gas containing carbon, silicon and any other material that is conducting and can be deposited from a precursor gas. Precursor gases can be located in cavities next to MOPFETs. When the cavities or precursors are activated, the MOPFET can use the gas to form a nano-wire junction between its drain and source using a modified Plasma Enhanced CVD process. The anno-wires can be turned off by applying sufficiently large $V_{ds}$.

Figure 7A:
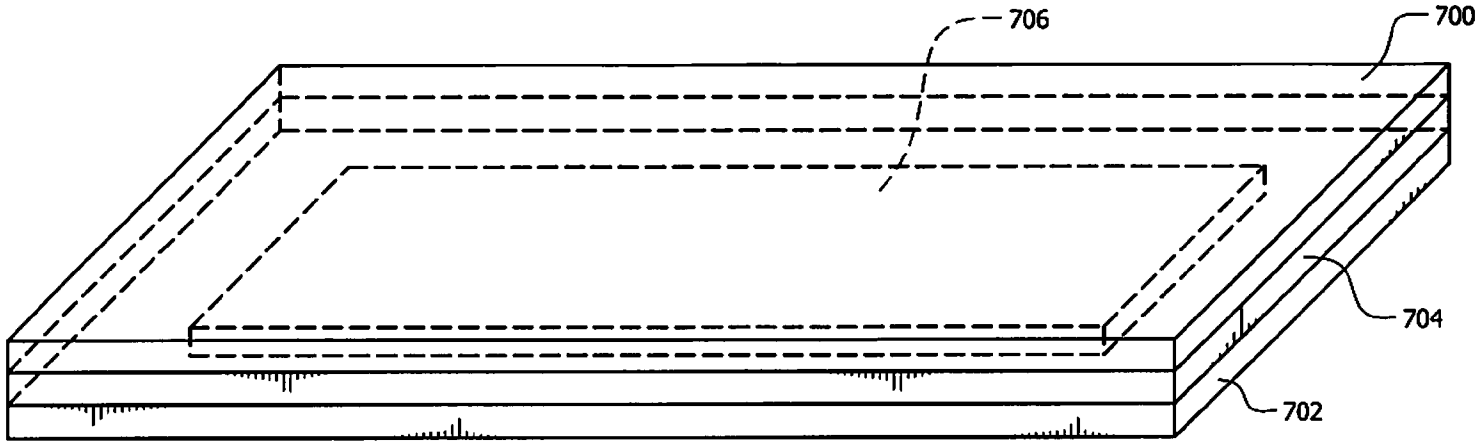
FIG. 7(*a*) depicts an isometric view of an anodic bonding arrangement in accordance with the present disclosure.
Figure 7B:
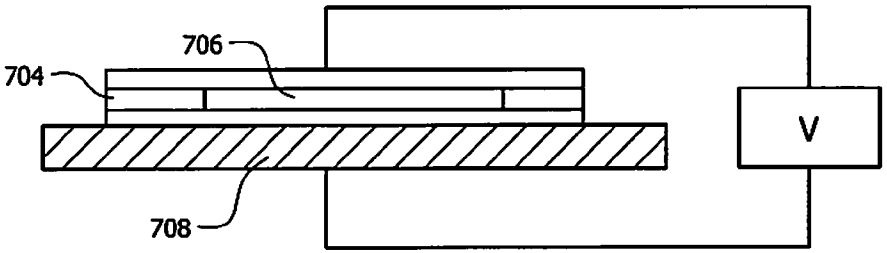

Referring to FIG. 7(*a*), an anodic bonding arrangement results from simultaneous bonding together of three sections, including a top plate 700, a bottom plate 702, and a middle plate 704 having a cavity 706 for gasses. The bonding may be performed at gas (He, Ar, etc.) pressure that is desired to fill the cavity 706 of the middle plate. The circuit and RF plasma metallization leads are not shown. The metal line may require oxide coatings for the anodic bonding to work. Referring to FIG. 7(*b*) the anodic bonding process may be carried out by placing the assembled plates on a hot plate 708 inside a gas with pressure P to ensure that the cavity 706 of the middle plate 704 will contain the gas at that pressure.

Figure 8:
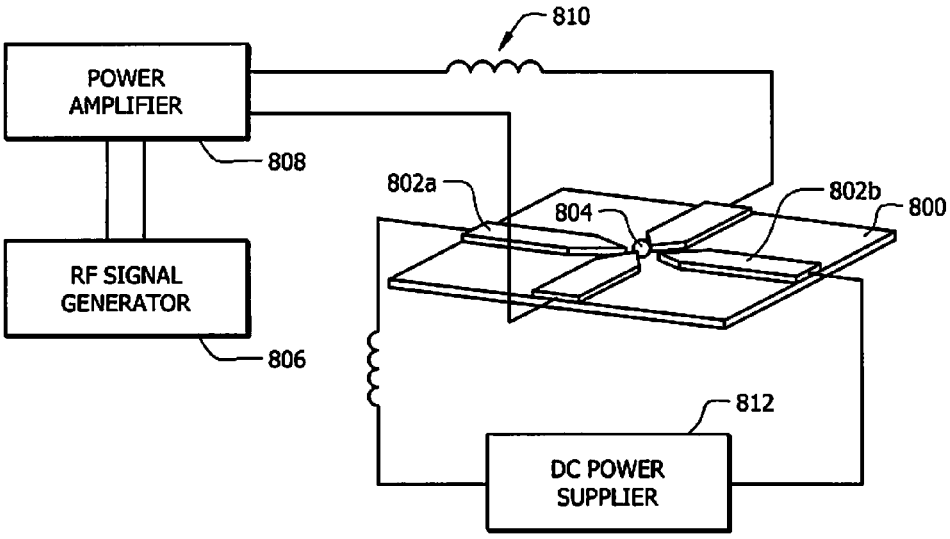
FIG. 8 depicts a diagrammatic view of another embodiment of a micro-plasma device in accordance with the present disclosure.
Figure 9:
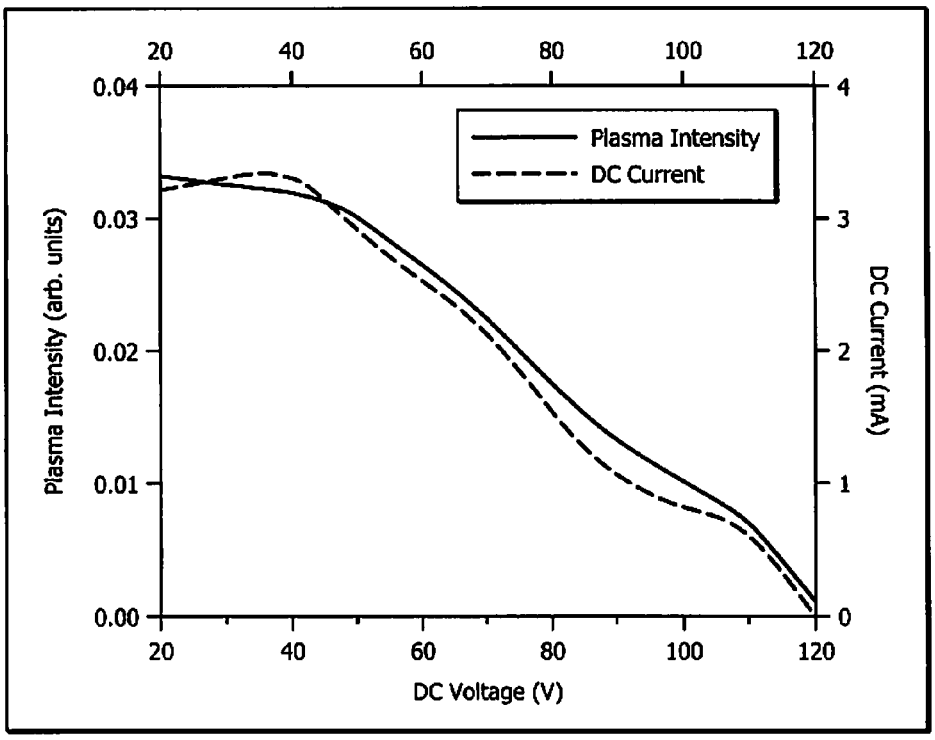
FIG. 9 depicts a graphical representation of the field effect of the micro-plasma device of FIG. 8.

Turning now to FIG. 8, another embodiment of an MPD may be comprised of a dielectric board 800 having a pair of switch electrodes 802*a* and 802*b* and RF plasma 804 generated by a pair of plasma generating electrodes. The plasma generators may be driven by an RF signal generator 806 via a power amplifier 808 and matching inductor 810. The switch electrodes may be driven by a DC power supplier 812. With this arrangement, the field effect of MPDs can be demonstrated, as shown in FIG. 9, where plasma intensity and DC current are graphically illustrated to vary with DC voltage.

Figure 10:
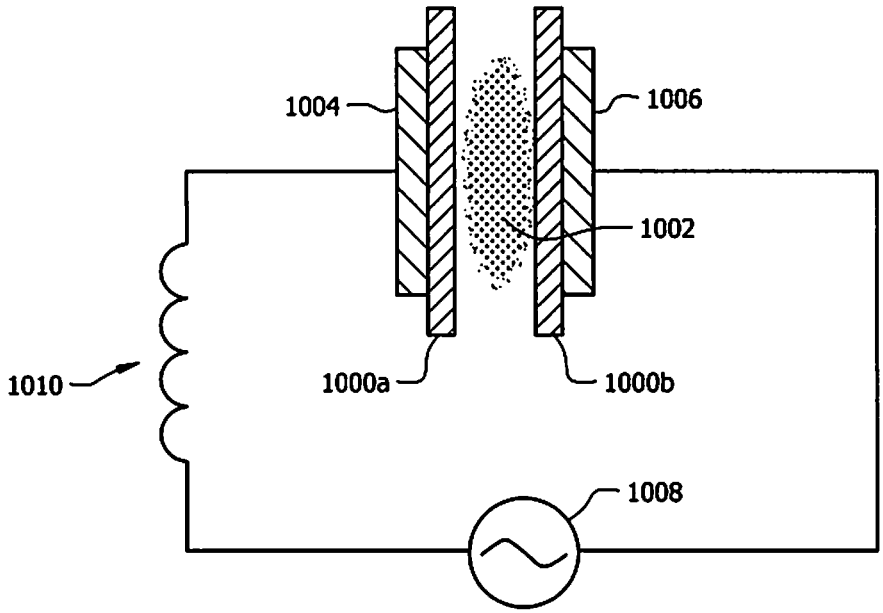
FIG. 10 depicts a sectional view of a further embodiment of a micro-plasma device in accordance with the present disclosure.
Figure 11:
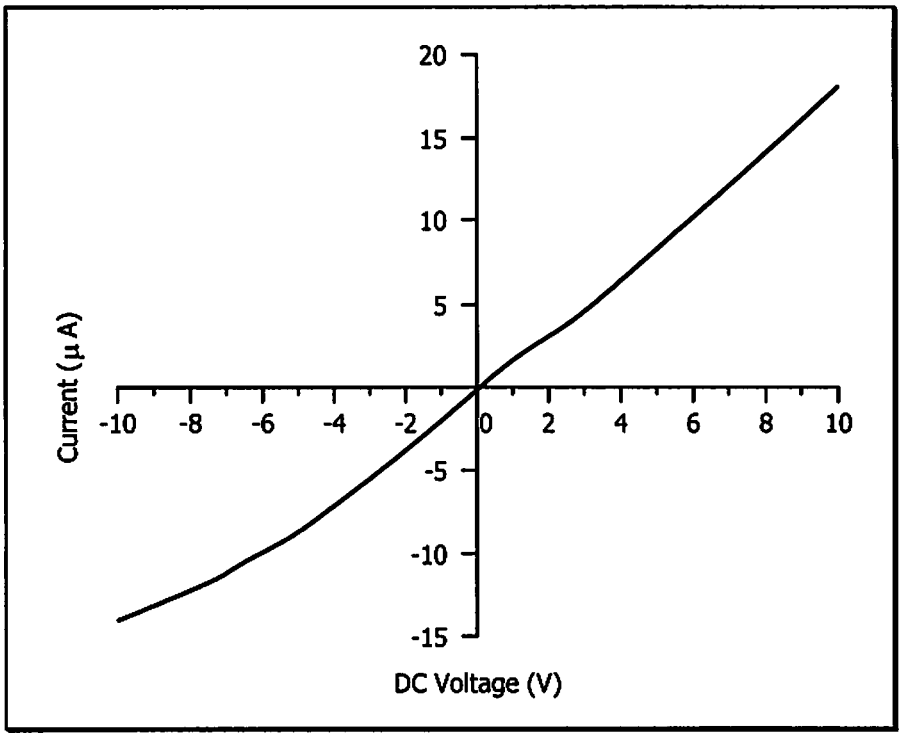
FIG. 11 depicts a graphical representation of the I-V characteristics of the micro-plasma device of FIG. 10.

Turning to FIG. 10, a further embodiment of an MPD may be designed with insulators for increased device lifetime. For example, a glass barrier 1000*a* and 1000*b* may be provided between He plasma 1002 and plasma generating electrodes 1004 and 1006. The electrodes 1004 and 1006 may be driven by an RF power supply 1008 via a matching inductor 1010. With this arrangement, the I-V characteristics of RF plasma between the glass barrier 1000 insulators may be measured by two electrodes 1004 and 1006 inside the He plasma 1002. The I-V characteristics thus measured are graphically illustrated in FIG. 11.

Figure 12:
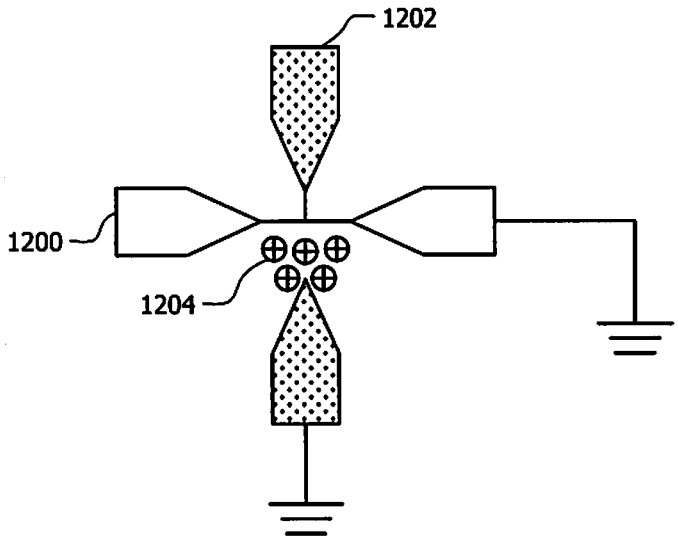
FIG. 12 depicts a plan view of the micro-plasma device of FIG. 8 demonstrating the switching off principle of plasma in accordance with the present disclosure.
Figure 13:
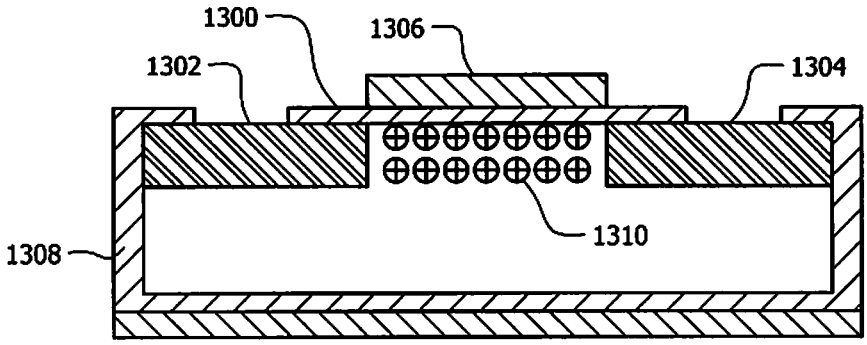
FIG. 13 depicts a sectional view of a micro-plasma transistor in accordance with the present disclosure.

Turning to FIG. 12, the switching off principle of plasma is demonstrated with the four probe setup outlined in FIG. 8. With RF power 1200 supplied to the plasma generating electrodes, and a voltage 1202 greater than zero supplied to the switching electrodes, the positively charged plasma ions 1204 are pushed away from the positively charged electrode. Thus, referring to FIG. 13, in a plasma transistor having a gate oxide 1300, source electrode 1302, drain electrode 1304, gate electrode 1306, and cavity with noble gases 1308, plasma ions 1310 between the source electrode 1302 and drain electrode 1304 may be affected by the voltage supplied to the gate electrode 1306.

The mode of operation of the transistor depends on the density of the ions 1310. For example, if the ion 1306 density is high, the insulated gate electrode 1306 can easily attract the ions 1310 or repel them. The ions 1310 are positively charged and can transfer electrons from the source electrode 1302 to drain electrode 1304. When their concentration increases in the D-S channel, they increase the Ids. When the plasma ion 1306 density is sufficiently high, the gate electrode 1306 field effect depletes the D-S channel to reduce the channel conductance. Accordingly, the conductive path between the source electrode 1302 and drain electrode 1304 provided by the plasma ions 1310 may be switched off by supply of voltage to the gate electrode 1306. On the other hand, when the starting ion 1310 density is low, D-S voltage ionizes the gas molecules. However, the ionization occurs at smaller voltage because of the presence of some ions that help the process. The gate electrode 1306, in this case, changes the "starter ion" concentration and modifies the ionization voltage. Thus, the same transistor operates as an enhancement mode device when the plasma density is low, but sufficient to enable Vds to ionize near-by gas molecules and increase the D-S channel conductance.

Figure 14:
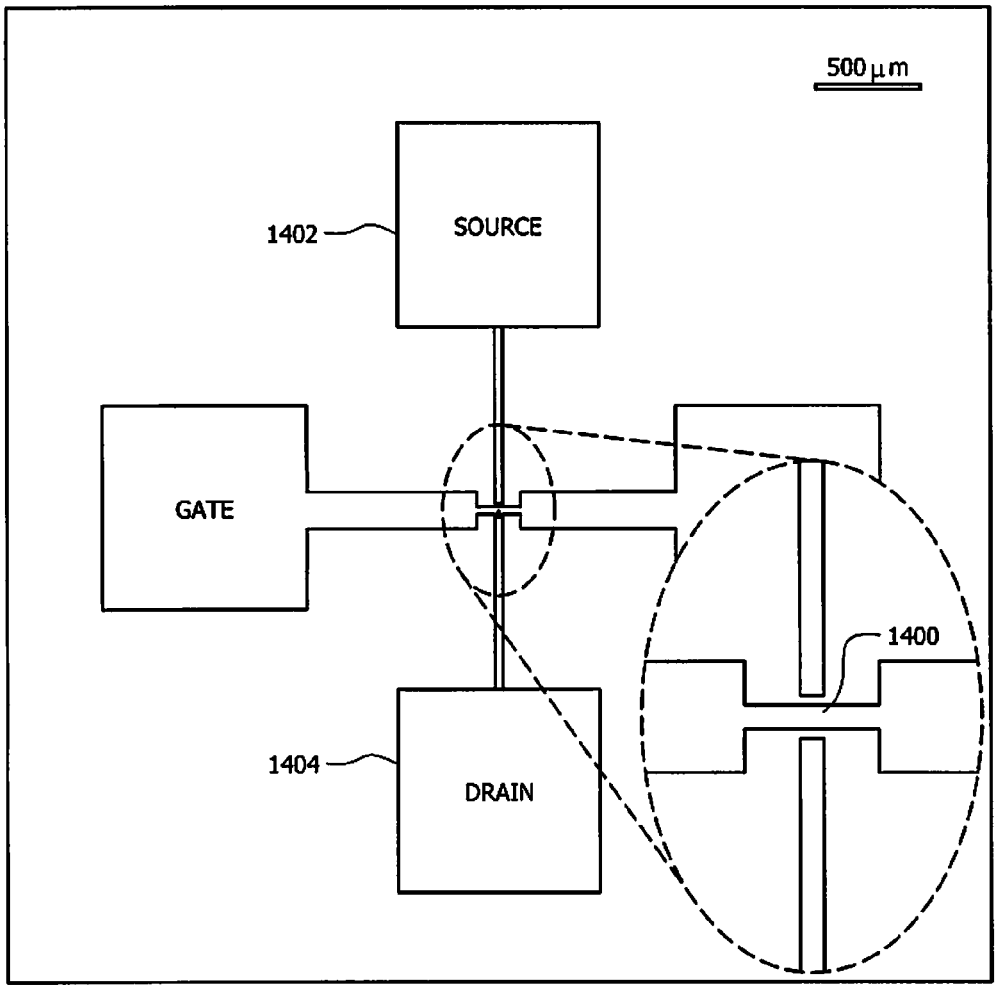
FIG. 14 depicts a sectional view of a fabricated MOPFET in accordance with the present disclosure.
Figure 15:
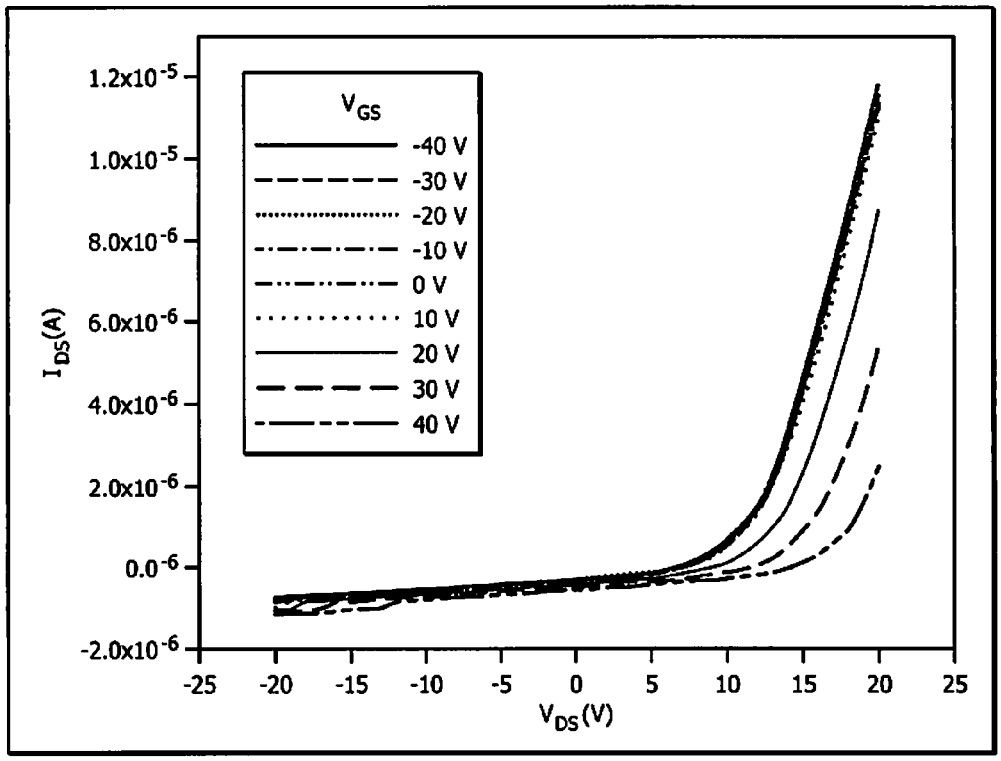
FIG. 15 depicts a graphical representation of the $I_{DS}$-$V_{DS}$ of a MOPFET for a variety of $V_{GS}$ in accordance with the present disclosure.
Figure 16:
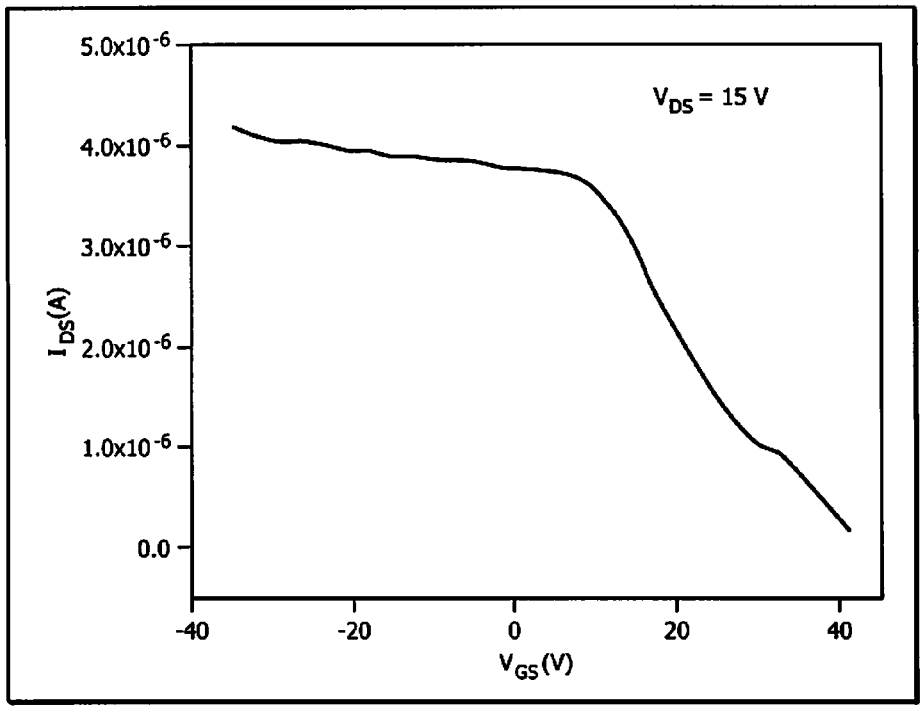
FIG. 16 depicts a graphical representation of the $I_{DS}$-$V_{GS}$ of a MOPFET for a $V_{DS}$ equal to 15V in accordance with the present disclosure.
Figure 17:
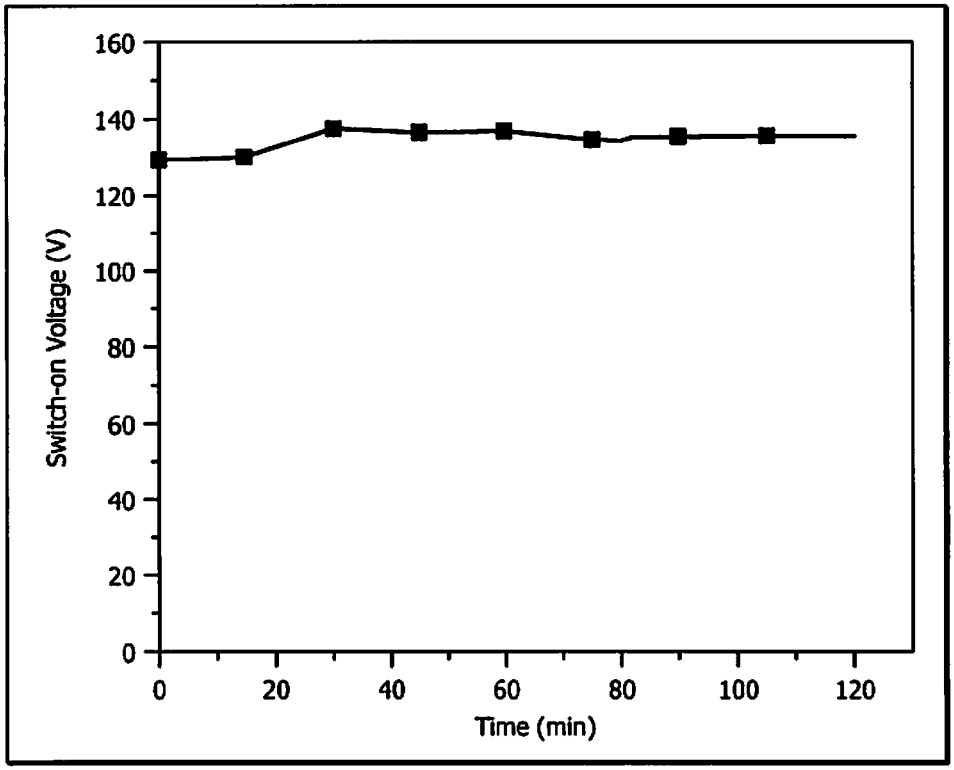
FIG. 17 depicts a graphical representation of the tested switching characteristics of a MOPFET inside a 90 keV nuclear reactor in accordance with the present disclosure.
Figure 18:
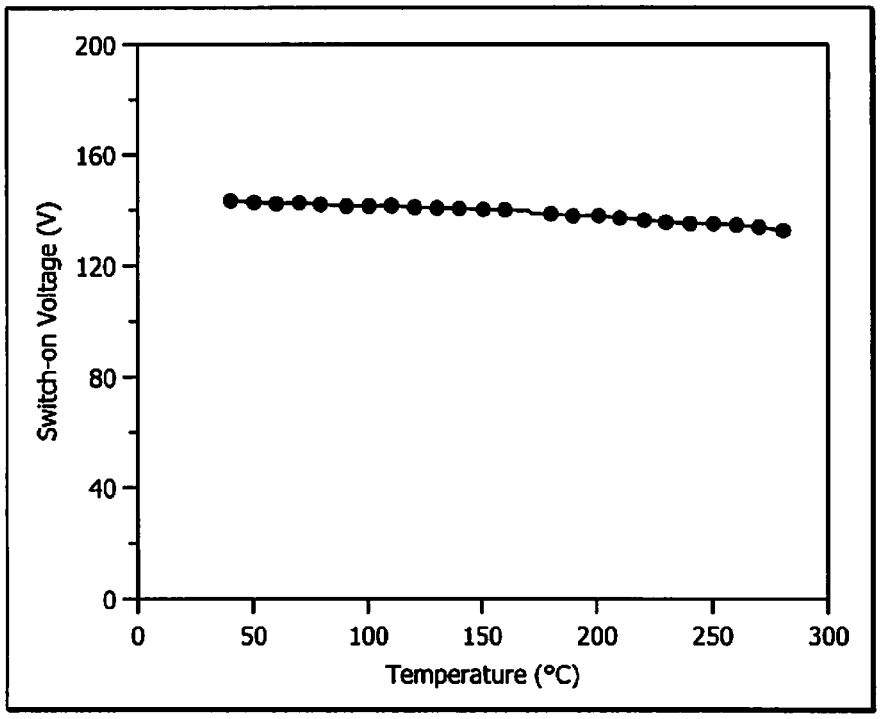
FIG. 18 depicts a graphical representation of the tested switching operation of a MOPFET at high temperatures in accordance with the present disclosure.

Turning to FIG. 14, a fabricated MOPFET demonstrates the dimension of a 15 μm gap 1400 between a source electrode 1402 and a drain electrode 1404. In this embodiment, the RF plasma is provided by a external plasma source. FIG. 15 demonstrates the $I_{DS}$-$V_{DS}$ of such a MOPFET for a variety of $V_{GS}$, while FIG. 16 demonstrates the $I_{DS}$-$V_{GS}$ for $V_{DS}$ equal to 15V. The tested switching characteristics of such an NE filled MOPFET inside a 90 keV nuclear reactor are graphically illustrated in FIG. 17, while FIG. 18 demonstrates the tested switching operation at high temperatures. Here, the switch-on voltage of the Ne filled plasma device decreases 1% at 100° C., and 4% at 200° C.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A micro-plasma device, comprising:

a plasma gas enclosure containing at least one plasma gas;

a plasma generation circuit interfaced with the plasma gas enclosure; and a plurality of electrodes interfaced with the plasma gas enclosure, wherein the plurality of electrodes includes a source electrode and a drain electrode.

2. The micro-plasma device of claim 1, wherein the at least one plasma gas includes at least one noble gas.

3. The micro-plasma device of claim 1, wherein the plasma enclosure is at least partially comprised of fused silica.

4. The micro-plasma device of claim 1, wherein the plasma generation circuit includes plasma generating electrodes.

5. The micro-plasma device of claim 4, wherein the plasma generating electrodes are formed as an interdigital transducer (IDT).

6. The micro-plasma device of claim 4, wherein the plasma generating electrodes are formed in a layer at least partially comprised of fused silica.

7. The micro-plasma device of claim 6, wherein the layer is bonded to the plasma enclosure.

8. The micro-plasma device of claim 1, wherein the plasma generation circuit includes an RF power source.

9. The micro-plasma device of claim 1, wherein the plasma generation circuit includes a matching inductor.

10. The micro-plasma device of claim 1, wherein the plurality of electrodes further includes an insulated gate electrode.

11. The micro-plasma device of claim 1, wherein the plurality of electrodes are formed in a layer at least partially comprised of fused silica.

12. The micro-plasma device of claim 11, wherein the layer is bonded to the plasma enclosure.

13. The micro-plasma device of claim 1, wherein the plasma generation circuit is configured to generate at least one of positive plasma ions and negative plasma ions.

14. A micro-plasma circuitry apparatus, comprising:

a first layer having plasma generating electrodes;

a second layer having a cavity formed therein;

a third layer having a circuit formed therein including a micro-plasma circuit (MPC) that includes one or more micro-plasma devices (MPDs); and a metallic layer covering the MPC except at locations of the MPDs, wherein the first layer is bonded to the second layer and the second layer is bonded to the third layer, thereby forming an enclosure that contains at least one plasma gas.

15. The micro-plasma circuitry apparatus of claim 14, wherein the second layer is at least partially comprised of fused silica.

16. The micro-plasma circuitry apparatus of claim 14, wherein the plasma generating electrodes are formed as an interdigital transducer (IDT).

17. The micro-plasma circuitry apparatus of claim 14, wherein the first layer is at least partially comprised of fused silica.

18. The micro-plasma circuitry apparatus of claim 14, wherein at least one MPD of the MPDs includes a plurality of electrodes.

19. The micro-plasma circuitry apparatus of claim 14, wherein the MPD is configured to operate in an enhancement mode.

20. The micro-plasma circuitry apparatus of claim 14, wherein the MPD is a metal-oxide-plasma field-effect transistor (MOPFET).

21. The micro-plasma circuitry apparatus of claim 20, wherein the MOPFET is configured to operate as at least one of a switch or an amplifier for the MPC.

22. The micro-plasma circuitry apparatus of claim 14, wherein the third layer is at least partially comprised of fused silica.

23. The micro-plasma circuitry apparatus of claim 14, wherein the MPC includes a NAND gate comprised of at least two of the MPDs.

24. The micro-plasma circuitry apparatus of claim 14, wherein the MPC includes a NOR gate comprised of at least two of the MPDs.

* * * * *

UNITED STATES PATENT AND TRADEMARK OFFICE

CERTIFICATE OF CORRECTION

PATENT NO. : 8,643,275 B2
APPLICATION NO. : 13/586717
DATED : February 4, 2014
INVENTOR(S) : Massood Tabib-Azar It is certified that error appears in the above-identified patent and that said Letters Patent is hereby corrected as shown below:

In the Specification

Column 1, Line 13, add the following:

STATEMENT REGARDING FEDERALLY SPONSORED
RESEARCH OR DEVELOPMENT

This invention was made with government support under No. N00014-11-1-0932, Office of Naval Research (ONR). The government has certain rights in the invention.

Signed and Sealed this
Second Day of September, 2014

Michelle K. Lee

Michelle K. Lee
*Deputy Director of the United States Patent and Trademark Office*